United States Patent [19]

Molchan

[11] 4,093,331

[45] June 6, 1978

[54] CONTAMINANT RESISTANT FEMALE CONNECTOR

[75] Inventor: Andrew John Molchan, Indianapolis, Ind.

[73] Assignee: Bell Telephone Laboratories, Incorporated, Murray Hill, N.J.

[21] Appl. No.: 796,991

[22] Filed: May 16, 1977

[51] Int. Cl.[2] ..... H01R 13/44

[52] U.S. Cl. ..... 339/39; 339/75 M

[58] Field of Search ..... 339/36, 39, 41, 44, 339/75 P, 75 M; 174/66, 67; 220/242

[56] References Cited

U.S. PATENT DOCUMENTS

| | | | |
|---|---|---|---|
| 1,989,823 | 2/1935 | Raabe | 339/75 P |
| 2,455,582 | 12/1948 | Hoessel | 339/41 |
| 2,559,151 | 7/1951 | Getzoff | 339/36 |
| 2,987,214 | 6/1961 | Radack | 220/242 |
| 3,656,083 | 4/1972 | Brook | 339/39 |
| 3,792,414 | 2/1974 | Smith | 339/39 |
| 3,955,870 | 5/1976 | Wasserman | 339/39 |
| 3,956,573 | 5/1976 | Myers et al. | 174/48 |

FOREIGN PATENT DOCUMENTS

| | | | |
|---|---|---|---|
| 1,180,816 | 2/1970 | United Kingdom | 339/44 M |

*Primary Examiner*—Neil Abrams
*Attorney, Agent, or Firm*—Harry L. Newman

[57] ABSTRACT

The connector includes a raised ridge that substantially surrounds the opening to a plug-receiving cavity. The connector further includes a pivotally mounted cover for the plug-receiving cavity that is biased toward a closed position. The cover extends into close proximity with the ridge when it is in its closed position and when it is in an in-use position adjacent to the closed position. In addition, the cover has a depending skirt that overlaps the sides of the ridges when the cover is in the closed and in-use positions. This configuration of and interaction between elements shields the contacts of the connector from dripping and sprayed liquids and retards the flow of moist and dusty air through the contact region.

4 Claims, 5 Drawing Figures

CONTAMINANT RESISTANT FEMALE CONNECTOR

This invention relates to the field of electrical connectors and within that field to contaminant resistant female connectors.

BACKGROUND OF THE INVENTION

Female connectors attached to the exterior surfaces of structures are exposed to the same conditions as and often treated as if they are no different from their supporting structure. Thus they are at times subject to dirt-laden and/or moisture-laden air coming into engagement with their contacts. They are also subject to having chemical solutions applied to their surfaces that may drip into the openings thereof in the process of they and/or their supporting structure being cleaned. In addition, when they are located adjacent to a washable floor, they are subject to having water and/or cleaning solutions propelled into the openings thereof by the swishing of a mop. They are further subject to having paint applied to their surfaces that (1) may drip into the openings thereof, (2) may be pressed into the openings thereof by the bristles of a brush or the nap of a roller, or (3) may be propelled into the openings thereof by a spray gun.

The entry of moisture, dirt of chemical solutions into the plug-receiving cavity can result in current leakage between and/or corrosion of the contacts contained therewithin. The application of paint to the plug-receiving cavity can produce a blockage in the cavity or a coating on the contacts that prevents establishing an electrical connection with the complementary male connector. It is therefore desirable for a female connector intended for attachment to the exterior surface of a structure to be designed to be resistant to these contaminants.

SUMMARY OF THE INVENTION

A female connector exemplary of the present invention includes a housing having a front wall and a plug-receiving cavity that is open to the front wall. A ridge projecting forwardly from the front wall substantially surrounds the opening to the plug-receiving cavity, and a plurality of contact springs situated within the plug-receiving cavity are recessed from the front end of the ridge. The back of the cavity is closed by a backplate.

A cover for the plug-receiving cavity is pivotally mounted on the housing and rotatable between a closed and an open position. The cover is biased toward the closed position and occupies an in-use position adjacent to the closed position when a complementary connector is positioned within the plug-receiving cavity. The cover includes a front wall that overlies the front wall of the housing and extends into close proximity with the forward end of the ridge when the cover is in the closed and in-use positions. In addition, the cover includes a skirt that extends rearwardly from the front wall of the cover and overlaps the sides of the ridge when the cover is in the closed and in-use positions.

The combination of having the back of the plug-receiving cavity closed, the front of the cavity surrounded by a ridge, and the cover being in close proximity to the ridge and having a skirt that overlaps the ridge results in a configuration that retards the flow of air into the contact region of the connector both when the cover is closed and in its in-use position. The potential for dirt-laden or moisture-laden air contaminating the contacts is therefore greatly reduced.

In addition, liquids dripping behind the connector are essentially blocked from the plug-receiving cavity by the backplate, while liquids dripping down the front wall of the housing are prevented from entering the cavity by the forwardly projecting ridge. Finally, liquids propelled toward the front wall of the connector or applied directly to the front wall of the connector are essentially blocked from the cavity by the cover. While the cover provides its greatest protection when it is closed, the diminution in protection afforded when it is in the in-use position is offset by the presence of the complementary male connector in the plug-receiving cavity.

DETAILED DESCRIPTION

Figure 1:
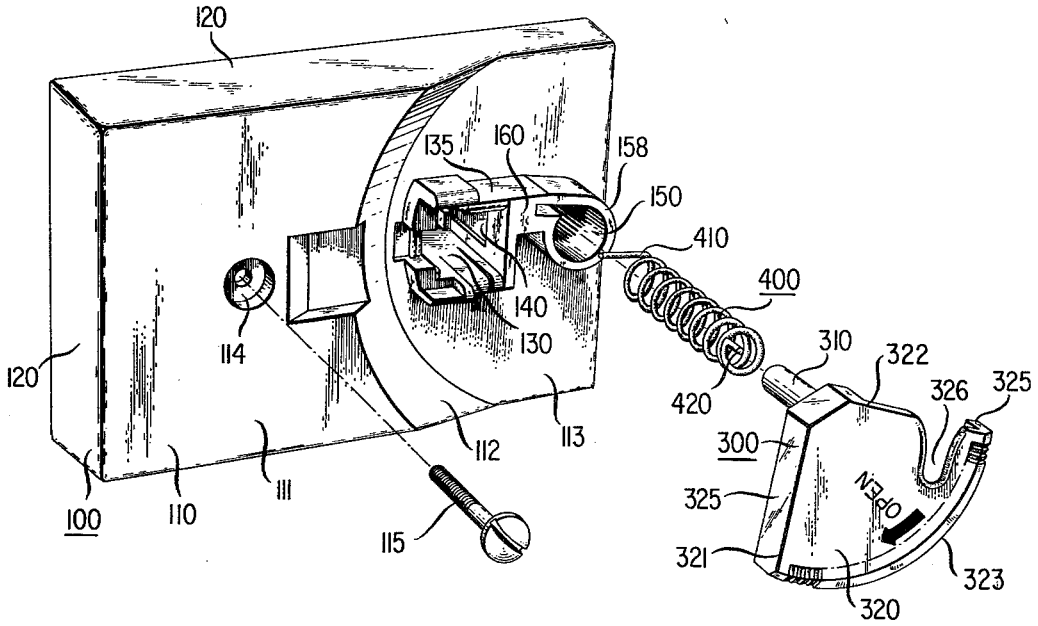
FIG. 1 is an exploded front perspective view of an exemplary embodiment of the connector of this invention.

Referring to FIG. 1 of the drawing, a connector in accordance with the present invention includes a hollow box-like housing 100 having a front wall 110 and rearwardly extending side walls 120. The rear edges of the side walls 120 lie in a common lane, while the front wall 110 is bilevel in that it includes a forward portion 111, an inclined portion 112, and a rearward portion 113.

The portion of the housing 100 that is of greater depth is adapted to enclose a terminal block (not shown) that is secured to a supporting structure and to which conductors external to the connector are connected. In addition, the forward portion 111 of the front wall 110 includes a recess 114 having an opening through which a fastener 115 extends that serves to secure the housing 100 to the terminal block.

The portion of the housing 100 that is of lesser depth includes a plug-receiving cavity 130 that is open to the rearward portion 113 of the front wall 110 and is surrounded by a forwardly projecting ridge 135. The plug-receiving cavity 130 has a similar configuration to that disclosed in U.S. Pat. No. 3,850,497 issued to C. L. Krumreich et al. on Nov. 26, 1974 in that it is shaped to accommodate a plug of the type disclosed in U.S. Pat. No. 3,761,869 issued to E. C. Hardesty et al. on Sept. 25, 1973. As described in the latter patent, this plug includes a cantilever latch that interacts with a notched wall of the plug-receiving cavity to secure the plug within the cavity, the latch having a tab at the free end thereof for releasing the plug from the cavity. In the present connector, the notched wall of the plug-receiving cavity 130 is located adjacent to the inclined portion 112 of the front wall 110, and the corresponding side of the ridge 135 is of a reduced height to provide access to the release tab of the plug.

Figure 2:
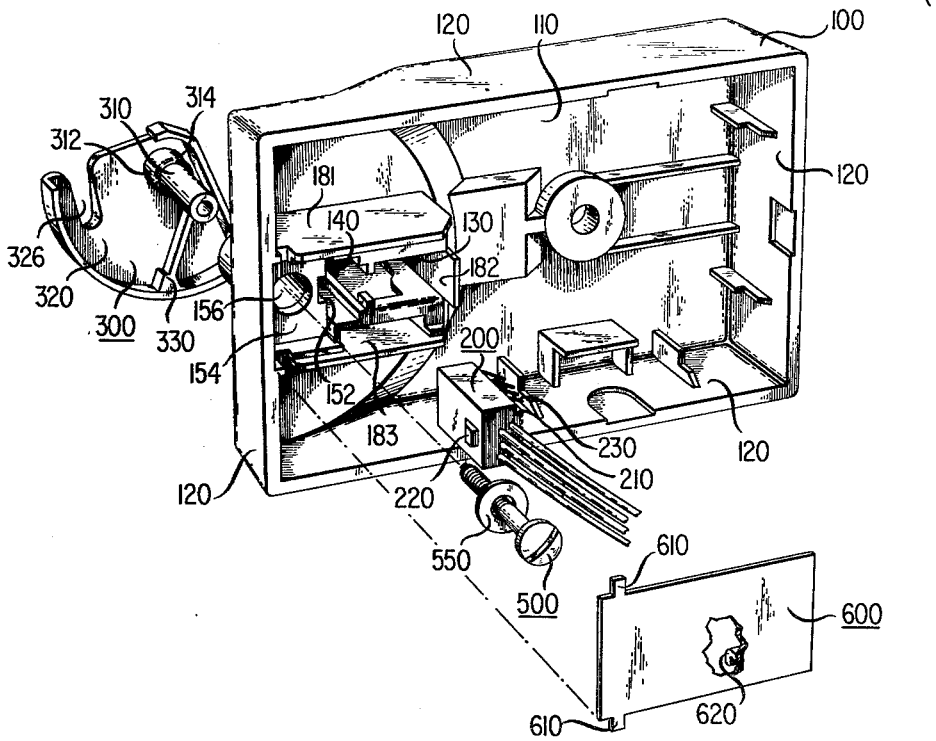
FIG. 2 is an exploded rear perspective view of the connector.

Referring now also to FIG. 2, the plug-receiving cavity 130 is also similar to that disclosed in C. L.

Krumreich U.S. Pat. No. 3,990,764 in that the side of the cavity opposite to the notched wall communicates with a carrier-receiving cavity 140 that is open to the rear of the housing 100. The carrier-receiving cavity 140 accommodates a dielectric contact carrier 200 that is similar to that disclosed in the Krumreich patent. The carrier 200 includes a pair of oppositely extending ledges 210 that serve to position the carrier within the cavity 140 and a protuberance 220 extending orthogonal to the ledges that are used to secure the carrier in place. Like the carrier described in the Krumreich patent, the carrier 200 supports a plurality of contact assemblies including wire spring contacts 230 that extend cantilever fashion beneath the side of the carrier opposite to the protuberance 220.

Figure 4:
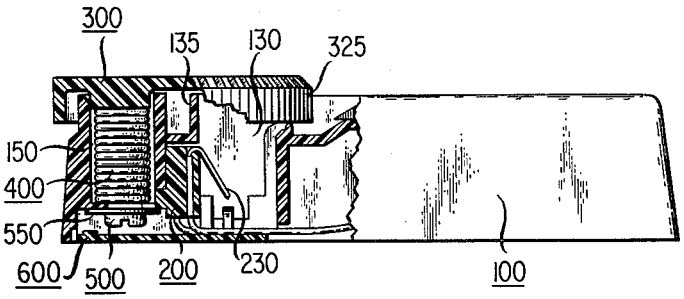
FIG. 4 is a top view with portions broken away to show the relationship between assembled elements.

As shown in FIGS. 2 and 4, when the carrier 200 is properly positioned within the cavity 140, the wire spring contacts 230 extend into the plug-receiving cavity 130. The configuration of the cavities 130 and 140 is such that the contacts 230 are recessed from the forward end of the ridge 135. In addition, when the carrier 200 is properly positioned within the cavity 140, the protuberance 230 is accommodated within a notch 152 in a rear wall 154 of a cylindrical spindle-receiving cavity 150.

Referring again to FIG. 1, the cavity 150 is open to the front wall 110 and is surrounded by a ridge 155 extending forwardly from the front wall that has essentially the same height as the ridge 135 surrounding the plug-receiving cavity 130. The cavity 150 accommodates a hollow cylindrical spindle 310 of a cover 300 to rotatively support the cover on the housing 100, the spindle extending perpendicular to and rearwardly from a front wall 320 of the cover.

The spindle 310 has a smaller diameter than that of the cavity 150, and as shown in FIG. 2, the rear wall 154 of the cavity has a circular opening 156 therein that is coaxial with the cavity and of the same diameter as the spindle. In addition, the spindle 310 includes an enlarged cylindrical base 312 at its juncture with the front wall 320 that is of the same diameter as the cavity 150. Thus with the rear end of the spindle 310 positioned within the opening 156 in the rear wall 154 of the cavity 150 and the base 312 of the spindle positioned within the cavity, the spindle is coaxially supported within the cavity. In addition, the length of the spindle 310 is such that when the rear surface of the front wall 320 is in engagement with the ridge 155 surrounding the cavity 150, the end of the spindle extends just beyond the rear wall 154 of the cavity.

Turning now to FIGS. 1 and 4, the space between the spindle 310 and the inside wall of the cavity 150 is occupied by a helical spring 400. The rear end of the spring 400 is terminated with a tangentially extending arm 410 and this arm is positioned within a slot 158 extending tangentially from the cavity 150. The front end of the spring 400, on the other hand, is terminated with a forwardly extending finger 420 and this finger is accommodated within a slot 314 (FIG. 2) in the case 312 of the spindle 310. The cover 300 includes a rib 330 (FIG. 2) extending rearwardly from the front wall 320, and the orientation of the arm 410 and finger 420 of the spring 400 and of the slot 314 and rib of the cover is such that when the cover is positioned on the housing 100 with the rib above the ridge 155, the spring 400 is wound to bias the cover in a counterclockwise direction as viewed in FIG. 1.

Referring to FIGS. 2 and 4, a screw 500 with a washer 550 disposed adjacent to its head is threaded into the rear end of the spindle 310 to rotatively secure the cover 300 to the housing 100 in the above-described position. The diameter of the washer 550 is of a size to overlap the notch 152 in the rear wall 154 of the spindle-receiving cavity 150, and thus the washer also serves to secure the carrier 200 within the carrier-receiving cavity 140 by overlapping the protuberance 220 on the carrier.

Figure 3:
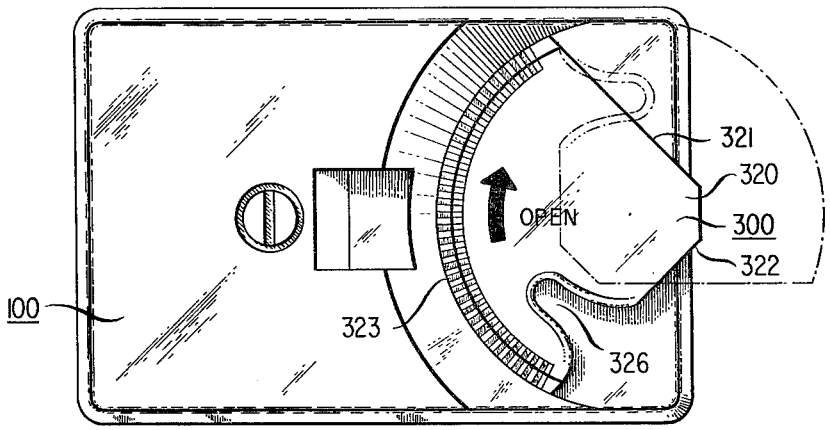
FIG. 3 is a front view of the connector in an assembled form with the cover in its closed position, the cover being shown in phantom in its open position.

Referring now to FIG. 3, the front wall 320 of the cover 300 is sector shaped in that it comprises a radially extending upper side 321 and lower side 322 joined by a circular side 323. The front wall 320 is of a size to overlie the plug-receiving cavity 130, and when no plug is positioned within the cavity, the counterclockwise bias of the spring 400 rotates the rib 330 (FIG. 2) into engagement with the ridge 135 (FIG. 1) surrounding the cavity to place the cover in the position shown in full line. It is seen that in this position, the plug-receiving cavity 130 (FIG. 1) is completely covered. In addition, as shown in FIG. 1 the front wall 320 includes a skirt 325 that extends rearwardly from the upper and circular sides 321 and 323, and the skirt is of a size to overlap the ridges 135 and 155 of the plug-receiving cavity 130 and spindle-receiving cavity 150, respectively.

The skirt 325 also extends from a small portion of the lower side 322 adjacent to its juncture with the upper side 321 and this portion of the skirt interacts with a stop 160 that bridges the ridges 135 and 155. The engagement of the lower side skirt portion 325 with the stop 160 limits the clockwise rotation of the cover 300 to the position shown in phantom in FIG. 3. In this position of the cover 300, the plug-receiving cavity 130 is completely exposed, and thus the cover is rotated to this position to insert a complementary plug into the cavity.

Figure 5:
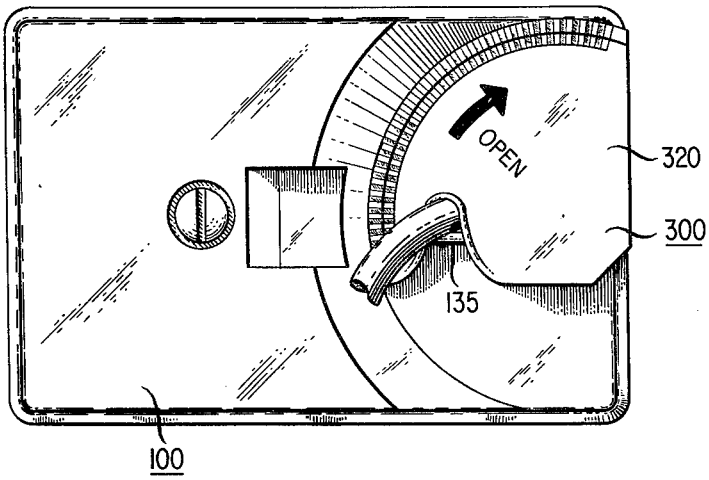
FIG. 5 is a front view of the connector with a complementary plug mated therewith.

When, after the complementary plug is inserted into the plug-receiving cavity 130, the cover 300 is released, it is rotated in a counterclockwise direction by the spring 400. The front wall 320 of the cover 300 includes a slot 326 extending from its lower side 322 generally concentric to its circular side 323, and the slot is in a position to accommodate the cord of the complementary plug. The slot 326 has a wide entrance and tapers from this entrance to a width that is substantially the same as the thickness of the plug cord. Thus the counterclockwise rotation of the cover 300 results in the sides of the slot 326 readily moving around the plug cord. This counterclockwise rotation is arrested when the end of the slot 326 engages the plug cord, and the length of the slot is such that the cover comes to rest in the position shown in FIG. 5.

In this in-use position, the cover is somewhat displaced from its closed position, but the plug-receiving cavity 130 is substantially completely covered. The only uncovered portion of the cavity 130 is that behind the slot 326 in the front wall 320, and the slot is substantially filled by the plug cord.

It is seen that the spindle-receiving cavity 150 and thereby the spring 400 are covered at all times. This in combination with the overlapping of the skirt 325 of the cover 300 with the ridge 155 surrounding the cavity 150 protects the spring 400 from contaminants.

Referring again to FIG. 2, additional protection is provided by a backplate 600. The housing 100 includes walls 181, 182 and 183 that extend rearwardly from the front wall 110 and combine with a portion of one of the side walls 120 to provide an enclosure about the plug-receiving cavity 130, the carrier-receiving cavity 140, and the spindle-receiving cavity 150. The backplate 600 is of a size to substantially close this enclosure. A gap is however advantageously provided at the side of the enclosure adjacent to the wall 182 for the leads from the contact carrier 200 to extend through, the leads being advantageously connected to the terminal block previously referred to. A pair of laterally extending tabs 610 on the backplate 600 are accommodated by notches in the walls 181 and 183 to locate the backplate with respect to the walls, and ledges extending alongside the walls 181 and 183 support the backplate between the walls. The notches in the walls 181 and 183 engage with the tabs 610 in an interference connection to aid in securing that end of the backplate to the housing 100. In addition, a pair of opposed L-shaped fingers 620 (one of which is shown) extending from the backplate 600 snap over bosses at the back of the plug-receiving cavity 130 to secure the backplate in place.

Although a single exemplary embodiment of this invention has been described in detail, those in the art appreciate that modifications may be made without departing from the novel and advantgeous features of this invention. Accordingly, all such modifications are intended to be included within the scope of this invention as defined in the appended claims.

What is claimed is:

1. A contaminant-resistant female connector comprising:

a housing including:

a front wall, a plug-receiving cavity that is open to the front wall, a ridge projecting forwardly from the front wall, the ridge substantially surrounding the opening to the plug-receiving cavity, a carrier-receiving cavity that is situated adjacent to the plug-receiving cavity, communicates with the plug-receiving cavity, and is open to the rear of the housing, and a spindle-receiving cavity that is open to the front wall;

a cover pivotally mounted on the housing and movable between a closed and an open position and having an in-use position intermediate the closed and open positions, the cover including a front wall overlying the front wall of the housing, the front wall of the cover extending into close proximity with the forward end of the ridge when the cover is in the closed and in-use positions, a skirt extending rearwardly from the front wall of the cover, the skirt overlapping the ridge when the cover is in the closed and in-use positions, and a spindle extending rearwardly from the front wall, the spindle being positioned within the spindle-receiving cavity of the housing;

means for biasing the cover toward the closed position;

a plurality of contact springs mounted on a dielectric carrier, the carrier being positioned in the carrier-receiving cavity of the housing; and means for rotatively securing the spindle within the spindle-receiving cavity and also retaining the carrier within the carrier-receiving cavity.

2. A connector as in claim 1 wherein the cover includes a rib extending rearwardly from the front wall thereof that engages the ridge surrounding the plug-receiving cavity to locate the cover in its closed position.

3. A connector as in claim 1 wherein the spindle and the spindle-receiving cavity are cylindrical, the spindle has a smaler diameter than that of the spindle-receiving cavity, a rear wall of the spindle-receiving cavity has a circular opening therein that is coaxial with the cavity and accommodates the rear end of the spindle, a helical spring is positioned within the spindle-receiving cavity and disposed about the spindle, the spring having one end secured to the housing and the other end secured to the cover and acting to rotate the cover toward its closed position, the carrier has a protuberance that is accommodated within a notch in the rear wall of the spindle-receving cavity, and a fastener having a washer disposed adjacent to its head, is threaded into the rear end of the spindle to secure the cover and helical spring in place, the washer overlying the protuberance on the carrier to also secure the carrier in place.

4. A connector as in claim 1 further including walls extending rearwardly from the front wall of the housing that surround the spindle-receiving cavity, the carrier-receiving cavity, and the plug-receiving cavity, and a backplate supported on the walls serves as a rear closure for the cavities.

* * * * *